US012075908B2

(12) United States Patent
Gunness

(10) Patent No.: US 12,075,908 B2
(45) Date of Patent: Sep. 3, 2024

(54) MAKEUP BRUSH

(71) Applicant: LUMETIQUE, INC., Irvine, CA (US)

(72) Inventor: Andrea Gunness, Gallatin, TN (US)

(73) Assignee: LUMETIQUE, INC., Irvine, CA (US)

( * ) Notice: Subject to any disclaimer, the term of this patent is extended or adjusted under 35 U.S.C. 154(b) by 544 days.

(21) Appl. No.: 17/221,210

(22) Filed: Apr. 2, 2021

(65) Prior Publication Data

US 2021/0227962 A1 Jul. 29, 2021

Related U.S. Application Data

(63) Continuation-in-part of application No. 16/846,466, filed on Apr. 13, 2020, now abandoned, and a continuation-in-part of application No. 16/700,754, filed on Dec. 2, 2019, now Pat. No. 11,751,676.

(51) Int. Cl.

| | |
|---|---|
| ***A46B 5/00*** | (2006.01) |
| ***A46B 3/06*** | (2006.01) |
| ***A46B 7/04*** | (2006.01) |
| ***A46B 9/02*** | (2006.01) |
| ***A46D 3/04*** | (2006.01) |
| *A46B 3/04* | (2006.01) |

(52) U.S. Cl.

CPC ..... *A46B 5/0095* (2013.01); *A46B 3/06* (2013.01); *A46B 7/042* (2013.01); *A46B 7/044* (2013.01); *A46B 9/021* (2013.01); *A46D 3/045* (2013.01); *A46B 3/04* (2013.01); *A46B 2200/1046* (2013.01)

(58) Field of Classification Search

CPC ..... A46B 3/04; A46B 3/06; A46B 5/0095; A46B 7/04; A46B 7/042; A46B 7/044; A46B 9/021; A46B 2200/1046

See application file for complete search history.

(56) References Cited

U.S. PATENT DOCUMENTS

| | | | | |
|---|---|---|---|---|
| 3,577,582 | A | 5/1971 | Aston | |
| 5,220,702 | A | 6/1993 | Howell | |
| 6,014,785 | A | 1/2000 | Punch | |
| 6,510,578 | B1 | 1/2003 | Cy | |
| 7,228,864 | B2 * | 6/2007 | Tahara | A46B 11/0006 401/117 |
| 9,433,280 | B2 | 9/2016 | Hartstock | |

(Continued)

FOREIGN PATENT DOCUMENTS

| | | | |
|---|---|---|---|
| EP | 1566116 | A2 | 8/2005 |
| EP | 1894489 | A2 | 3/2008 |
| JP | 2015503974 | A | 2/2015 |

OTHER PUBLICATIONS

International Search Report issued Jan. 2, 2020 in PCT/US2019/052575, 2 pages.

(Continued)

*Primary Examiner* — Randall E Chin

(74) *Attorney, Agent, or Firm* — Element IP, PLC

(57) ABSTRACT

The present invention is a makeup brush with a releasably connectable ferrule and handle, so that the ferrules and handles are interchangeable. The means for releasably connecting the ferrule and the handle may be, for examples, by friction fit or by the inclusion of sliding features, such as a notch and channel, such being additional methods for releasable connectivity beyond those already patented and/or developed by the inventor.

6 Claims, 13 Drawing Sheets

Section A-A

(56) References Cited

U.S. PATENT DOCUMENTS

| | | | | |
|---|---|---|---|---|
| 9,642,441 | B1 | 5/2017 | Ajootian | |
| 2003/0005533 | A1 | 1/2003 | Woodnorth | |
| 2005/0022326 | A1 | 2/2005 | Lee | |
| 2008/0224528 | A1 | 9/2008 | Wang | |
| 2010/0095973 | A1 | 4/2010 | Shrier | |
| 2010/0101035 | A1 | 4/2010 | Nakamura | |
| 2011/0023249 | A1 | 2/2011 | Boucherie | |
| 2012/0298130 | A1 | 11/2012 | Telwar | |
| 2013/0125921 | A1* | 5/2013 | Celia | A45D 33/00 132/313 |
| 2015/0026905 | A1 | 1/2015 | Jensen | |
| 2020/0015579 | A1 | 1/2020 | Barad | |
| 2022/0022634 | A1* | 1/2022 | Rybacek | A46B 5/0095 |

OTHER PUBLICATIONS

Screenshots of Amazon advertisement for Klix makeup brushes, taken Sep. 25, 2019, www.amazon.com. 1 page—although listed as "patent pending", Applicant has been unable to identify patent documents.

U.S. Final Office Action issued Oct. 20, 2022 in U.S. Appl. No. 16/846,466, 9 pages.

Written Opinion issued Jan. 2, 2020 in PCT/US2019/052575, 8 pages.

* cited by examiner

Section A-A

Section B-B

MAKEUP BRUSH

CLAIM OF PRIORITY

This application is a continuation in part application of and claims the benefit of priority of co-pending U.S. patent application Ser. No. 16/700,754 filed on Dec. 2, 2019, now U.S. Pat. No. 11,751,676, and 16846466 filed on Apr. 13, 2020, now abandoned, which are a continuation in part and continuation application of U.S. Pat. No. 10,820,684, respectively.

FIELD OF THE INVENTION

The present invention relates to cosmetic application technology, and in particular, to the manufacture of an improved makeup brush and makeup brush itself.

BACKGROUND

Brushes of varying types have almost universal utility, from industrial uses, to personal uses, to artistic endeavors, etc. The bristles of these various brushes may be made of a wide variety of materials, including hair, fur, synthetic filaments, etc. What all of these brushes have in common is that the bristles tend to fall out with use.

Most brushes have a metal or plastic ferrule that hold the bristles in the brush. The bristles are glued or tied within the ferrule to hold them in place. Incomplete gluing during manufacture may cause the bristles to fall out of the brush during use. High-end brushes often maintain their bristles better because they are laid into the ferrule by hand. This requires time-consuming gluing and securing of the bristles, but does result in a better product in so far as bristle loss. Even this, however, is not a complete solution, as the brush will ultimately still lose bristles. Obviously, if the brush loses all of its bristles, it will also have lost all of its utility in that capacity. The loss of only some bristles will not necessarily greatly affect the utility of the brush, however. The loss of the bristles does interfere with the purpose of the application though. The material being applied by the brush and the surface to which the material is being applied may become contaminated with bristles lost from the ferrule.

A further disadvantage in the current design of brushes is that contamination by the glue usually make the bristles and brush non-recyclable or reusable. Another disadvantage is inevitable bacterial contamination of the bristles over time. Regular cleaning of the brushes requires specialized products in which the brushes must be immersed. After this immersion, the brushes must dry. All in all, the cleaning is an expensive and time-consuming process. Moreover, the cleaning process further breaks down the shape and structure of the brush, as well as the glue holding the bristles in place within the ferrule. This ends up exacerbating the original problem discussed above, of bristle loss. In short, even the most expensive and carefully laid-in brush will eventually degrade to the point where it must be replaced. Unfortunately, these unusable brushes are then deposited in landfills, as there is no way to recycle these items.

Therefore there is a need for a makeup brush that is inexpensive to produce; does not lose bristles; is entirely recyclable; and/or includes several brush heads that may be used for different applications and that may be replaced over a universal handle.

The inventor has ably addressed these issues in U.S. Pat. No. 10,820,684, which is hereby incorporated by reference. The present invention discloses alternative methods of interchangeability and reattachment of the ferrule and handle of a makeup brush from those disclosed therein. Since the invention of the makeup brush disclosed in U.S. Pat. No. 10,820,684, at least one other company has begun selling detachable makeup brushes under the brand name ECOTOOLS.

SUMMARY OF THE INVENTION

The present invention is a method for manufacturing an improved makeup brush and the makeup brush manufactured from the method. Although all references herein are to a makeup brush, it is understood that the use of the brush of the present invention need not be limited to makeup application.

In its most basic form, the method for manufacturing an improved makeup brush includes the following steps: molding a ferrule and welding bristles to the ferrule well of the ferrule. The ferrule includes a ferrule inner end; a ferrule outer end; a ferrule body with a length extending between the inner and outer ends; an interior; and a ferrule well. The ferrule well has a ferrule well base parallel to the ferrule outer end. The ferrule well base has an inner side that faces the interior of the ferrule body and an outer side that faces the ferrule outer end of the ferrule. Each of the bristles includes a bristle outer tip, a bristle inner tip, and a length extending between the bristle outer and inner tips. The step of welding the bristles includes the steps of disposing the bristle inner tips in contact with the outer side of the ferrule well base of the ferrule; and exposing the inner side of the ferrule well base of the ferrule to welding.

It is preferred that the step of molding the ferrule is accomplished by injection molding, but other types of molding common in the art may be substituted. In preferred embodiments, the ferrule well base of the ferrule well is set slightly within the interior of the ferrule body. In such embodiments, the ferrule well also includes ferrule well sides connecting the ferrule well base to the ferrule outer end.

It is also preferred that the ferrule include means for connecting the ferrule to a handle of the makeup brush. The connecting means are preferably releasable connecting means. The preferred releasable connecting means are snapping features on each of the ferrule and the handle of the makeup brush, where the ferrule and handle snapping features mate with one another. The preferred ferrule snapping feature is an indentation extending inward from the interior of the ferrule body, which mates with a protrusion extending outward from the handle, which is the handle snapping feature. In another embodiment, the snapping features are reversed so that the ferrule snapping feature is a protrusion extending into the interior of the ferrule body and the handle snapping feature is an indentation that mates with the protrusion. Another means for connecting the ferrule to the handle would be by including mateable threading on each of the ferrule and handle so that they may be screwed together. One of at least ordinary skill in the art will recognize not only that there are many specific embodiments in which these snapping features may be formed, but also that the connecting means take various forms other than as snapping features. Each of these connecting means, whether they are snapping features are not, are contemplated as being within the scope of this invention.

In another preferred embodiment, the releasable connecting means are sliding features on each of the ferrule and the handle of the makeup brush, where the ferrule and handle sliding features mate with one another. The preferred sliding features are at least one notch and at least one corresponding channel through which the notch can slide. The notch is any protrusion, outdent, detent, or bulge. The term "notch" is used to disambiguate these sliding features from the snapping features discussed above. In a first version, the notch protrudes outward from the interior of the ferrule body, which mates with the channel that is carved into the ferrule end of the handle. The notch in the ferrule body mates with the channel and then slides through the channel to connect the ferrule and the handle. In a second version, the notch protrudes outward from the ferrule end of the handle and the channel is carved into the interior of the ferrule body. These first and second versions may be used when the ferrule end of the handle is inserted into the ferrule. As discussed above, however, there are embodiments of the makeup brush of the present invention where the ferrule inner end of the ferrule is inserted into the handle. With these embodiments, there is a third version where the notch protrudes outward from the exterior of the ferrule body and mates with the channel carved into the inside of the ferrule end of the handle. Finally, there is a fourth version where the notch protrudes outward from the ferrule end of the handle and mates with the channel carved into the interior of the ferrule body. The first and fourth versions may be preferred because the second and third versions require the sides of the ferrule body inner end or the sides of the ferrule end of the handle, respectively, to be thick enough to be structurally sound while also accommodating the carved out channel. For any of the four versions discussed above, there may be more than one (preferably two) notches and more than one (preferably two) corresponding channels.

The releasable connectivity through such sliding features provides a very secure attachment. Once the notch has been slid into place within the channel, it would be difficult to undo the attachment without intending to do so. In other words, if the makeup brush were freely moving amongst other items in a travel bag or purse, it is unlikely that the ferrule and handle will detach. While it is not difficult for a user to so detach, the user may rely on a stable and durable attachment when he does not wish the makeup brush to separate.

In some embodiments of the makeup brush of the present invention, the ferrule and handle are releasably connectable through friction. The "means" for releasable connection in these embodiments are inherent in the structure of these embodiments. In such embodiments, the handle includes a handle well extending into the handle between the ferrule end of the handle and a handle well base that is a distance of a well height into the handle. The handle well has a handle well outer diameter at the ferrule end of the handle. The handle well has a handle well inner diameter at the handle well base. The handle well outer diameter is greater than the handle well inner diameter, so that the handle well is tapered. In these embodiments, the ferrule body has a corresponding tapered shape to fit into the handle well. The ferrule body has a widest point with a ferrule body widest diameter. This widest point may be at the ferrule outer end, in which case, the ferrule body widest diameter is the same as the ferrule outer end diameter, as described below. The widest point of the ferrule body may be between the ferrule inner and outer ends, however. The ferrule body widest point diameter is greater than the ferrule inner end diameter, which creates a tapered shape of the ferrule body. The ferrule inner end diameter is slightly greater than the handle well inner diameter and the ferrule body widest diameter is slightly greater than the handle well outer diameter. When the ferrule body is inserted far enough into the handle well that the surfaces of the ferrule body and the handle well come into intimate contact, the surface to surface tensions between those surfaces will hold the ferrule body in place within the handle well. In some versions of this embodiment, the surfaces of the ferrule body and the handle well are textured to aid in this surface to surface tension that allows for the handle well sides to somewhat grip the ferrule body. The ferrule inner end will be able to get into the handle well, almost to the handle well base, but the slight difference in their diameters will prevent the complete insertion. The handle well sides are preferably slightly flexible so as to more easily allow for the insertion and removal of the ferrule body from the handle well.

In a similar embodiment of the makeup brush of the present invention, the handle well and ferrule body are not angled but cylindrical. In these embodiments, the handle well has a single, consistent handle well diameter and the ferrule body has a single, consistent ferrule body diameter. The ferrule body diameter is very slightly greater than the handle well diameter, but they are almost equal. The handle well has flexible handle well sides that can accommodate the ferrule body's slightly greater size when it is inserted into the handle well. It is preferred in these embodiments that the ferrule inner end have curved edges so as to more easily guide the ferrule body into the handle well.

This releasably connectivity through friction is especially conducive to brush cleanliness. In many of the other embodiments of the makeup brush described herein, the makeup brush, and particularly the makeup brush's means for releasably connectivity, may include notches, protrusions, indentations, and/or channels. When the consumer wishes to wash the brush, these notches and indentations may become areas where bacteria may be caught or where it may be difficult for water to evaporate, potentially causing moldiness. The friction releasable connectivity, on the other hand, provides only smooth surfaces that may cleaned without fear of such problem areas. The simplicity of the design of the makeup brushes that are releasably connectable through friction may also make these makeup brushes relatively less expensive to manufacture.

It is understood that in some embodiments of the makeup brush of the present invention, the handle is inserted into the ferrule, rather than the ferrule being inserted into the handle. In these embodiments described above that disclose a friction fit, either with a tapered or cylindrical ferrule body, it is understood that the structures will be reversed in embodiments where the handle is inserted into the ferrule. In other words, the ferrule would have the tapered or cylindrical well into which the tapered or cylindrical end of the handle would be inserted. In such embodiments, the well into which the handle is inserted should not be confused with ferrule well out of which the bristles extend. The well into which the handle is inserted is disposed at the ferrule inner end of the ferrule and the ferrule well out of which the bristles extend is disposed at the ferrule outer end of the ferrule.

It is preferred that the welding of the bristles to the ferrule base is through infrared, ultrasonic, or laser welding. Importantly, the welding (of whatever type) is applied to the other side of the ferrule well base than that from which the bristles extend. Specifically, the inner end of the bristles are disposed in contact with the outer side of the ferrule well base, while the welding is applied to the inner side of the ferrule well base. The energy of the welding extends through the ferrule well base so that the bristle inner ends become integrated with the outer side of the ferrule well base. As such, the bristles are never directly exposed to the welding. As the various types of welding may be fairly intense, this protects the bristles from that direct force or energy. Other types of welding than those listed above may be substituted, however, as may other forms of integration, such as injection molding. By integrating the bristles into the ferrule through welding, the ferrule and bristles become as one piece with no seams and no need for additional adhesion, such as with glue, or binding, such as with ties. As such, the bristles cannot fall out of the ferrule, and a disadvantage of the prior art is overcome.

It is preferred that the material out of which the ferrule and the bristles are made is a recyclable material, such as polybutylene terephthalate (PBT), which is a thermoplastic engineering polymer. Other polymers, and especially elastomers, such as those sold under the trademarks HYTREL and GRILFLEX, may be substituted. In addition, the material should be easily cleanable, including being at least somewhat heat and chemical resistant. As the ferrule and bristle combination is preferably recyclable, another disadvantage of the prior art is overcome. Moreover, even if the ferrule does eventually become unusable or undesirable for whatever reason, the ferrule may be recycled while the handle of the makeup brush is continually reused, as the handle and the ferrule inner ends of the ferrules, which connect to the handle, are standardized so that ferrules may be easily swapped out. In this way, one piece, the ferrule, is recycled, and the other piece, the handle, is reused—no part of the makeup brush ends up cluttering a landfill. In addition, plastics, such as those preferred with respect to the present invention, are easily cleaned and may be fairly rigorously cleaned without fear of the bristles falling out. Another disadvantage of the prior art is thus overcome. All of these factors weigh toward an inexpensive product, both to purchase and to maintain.

In its most basic form, the makeup brush of the present invention includes a handle, a ferrule, and a plurality of bristles. The handle has a ferrule end and a holding end. The ferrule includes a ferrule inner end connected to the ferrule end of the handle, a ferrule outer end, an interior, a ferrule body with a length extending between the inner and outer ends and around the interior, and a ferrule well at said ferrule outer end, where the ferrule well comprises a ferrule well base parallel to the ferrule outer end. The ferrule well base includes an inner side that faces the interior of the ferrule body and an outer side that faces the ferrule outer end of the ferrule. Each of the plurality of bristles includes a bristle outer tip, a bristle inner tip, and a length extending between the bristle outer and inner tips. The bristles extend out of the ferrule such that the inner tips of the bristles are integrally attached to the outer side of the ferrule well base of the ferrule.

The makeup brush of the present invention is a product of the method of the present invention. As such, several features discussed above with reference to the method of the present invention also apply to the makeup brush of the present invention, including that: the ferrule well of the ferrule is preferably set within the ferrule, but may be flush with the ferrule outer end; the handle and ferrule are releasably connectable and include means, such as mateable snapping features or threading, for achieving such releasable connectivity; the bristles are welded to the ferrule well base of the ferrule; and the ferrule and bristles are made of the same recyclable material, preferably PBT or another polymer. In addition, each of the ferrule outer and inner ends has a diameter. In some embodiments, the ferrule outer diameter is less than the ferrule inner diameter. That is to say, the ferrule tends to taper from where it connects with the handle to its ferrule outer end. It is also preferred that the ferrule outer end be round, such as circular or elliptical in shape. It is also preferred that the handle taper from the ferrule end to the holding end, so that the holding end is smaller than the ferrule end.

Therefore it is an aspect of the present invention that the ferrule is molded, preferably by injection molding.

It is a further aspect of the present invention that the bristles of the brush are made of the same material as the ferrule.

It is a further aspect of the present invention that the bristles of the brush are made integral with the ferrule through welding or other means.

It is a further aspect of the present invention that the ferrule is removable from the handle of the brush.

It is a further aspect of the present invention that the ferrule and handle include corresponding features so that they are releasably mateable, such as indentations and protrusions for snapping the ferrule and handle together or threading for screwing the ferrule and handle together.

It is a further aspect of the present invention that the ferrule and bristles be made of a recyclable material.

It is a further aspect of the present invention that the recyclable material out of which the ferrule and bristles are made is PBT or another polymer, such as thermoplastic elastomers or polyamide high performance elastomers.

It is a further aspect of the present invention that the ferrule and bristles be easily cleanable and that cleaning does not break down the shape or structure of the bristles.

It is a further aspect of the present invention that the outer end of the ferrule has a smaller diameter than the inner end of the ferrule.

It is a further aspect of the present invention that the outer end of the ferrule is round in shape, such as circular or elliptical.

It is a further aspect of the present invention that the handle of the makeup brush tapers so that it is larger at its ferrule end and smaller at its holding end.

These aspects of the present invention are not meant to be exclusive and other features, aspects, and advantages of the present invention will be readily apparent to those of ordinary skill in the art when read in conjunction with the following description and accompanying drawings. Although not every feature may be initially claimed, each feature is considered to be a part of the present invention.

DETAILED DESCRIPTION

Figure 1:
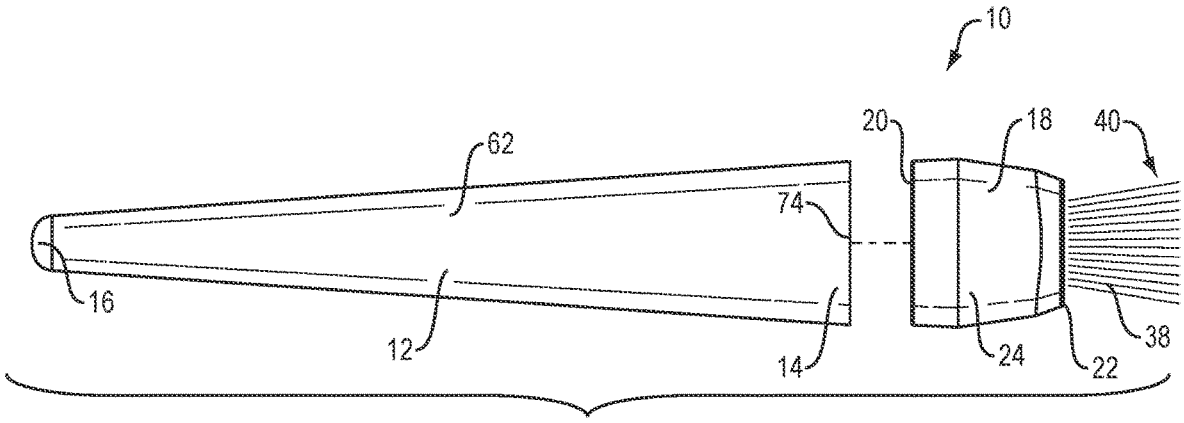
FIG. 1 is a side view of a makeup brush of the present invention.

Referring first to FIG. 1, a side view of a makeup brush 10 of the present invention is provided. Makeup brush 10 includes handle 12 and ferrule 18. Handle 12 has ferrule end 14, where handle 12 connects to ferrule 18, and holding end 16, where a user will hold handle 12. Handle 12 preferably tapers 62 from ferrule end 14 to holding end 16 so that ferrule end 14 is wider than holding end 16. It is understood, however, that handle 12 may be uniform in width. Handle 12 may include cap 74 that covers ferrule end 14. Ferrule 18 includes ferrule inner end 20, which connects with ferrule end 14 of handle 12, and ferrule outer end 22, which faces away from handle 12. Ferrule 18 also includes ferrule body 24. Although shown more clearly in FIG. 2A, it is understood that ferrule body 24 has an interior 68 and ferrule well 28. Bristles 38 with bristle outer tips 40 extend from ferrule outer end 22. Throughout these FIGS., the discussion focuses on handle 12 and ferrule 18 being separate pieces that may be releasably connected. It is understood, however, that in some embodiments, handle 12 and ferrule 18 are a single, permanently integrated makeup brush 10.

Figure 2A:
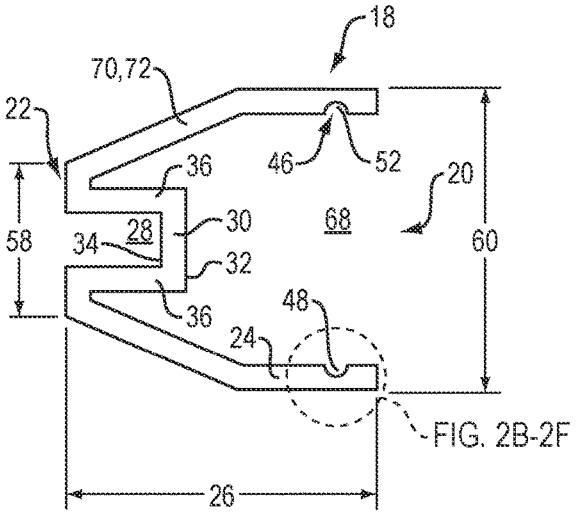
FIG. 2A is a side cutaway diagram of a ferrule of a makeup brush of the present invention.

Now referring to FIG. 2A, a side cutaway diagram of ferrule 18 is provided. Ferrule outer end 22 has diameter 58. Ferrule inner end 20 has diameter 60. Ferrule length 26 extends between inner end 20 and outer end 22. As shown, and as preferred, diameter 58 of ferrule outer end 22 is less than diameter 60 of ferrule inner end 20. Ferrule 18 is preferably made of recyclable material 70, such as PBT 72. In this view, we see ferrule well 28. Ferrule well 28 is disposed parallel 76 to ferrule outer end 22. In the embodiment shown, ferrule well 28 extends into interior 68 of ferrule 18 and includes ferrule well sides 36 connecting ferrule outer end 22 to ferrule well base 30. In other embodiments, such as that shown in FIG. 5B, for example, ferrule well 28 is flush with ferrule outer end 22 and does not include ferrule well sides 36. Ferrule well base 30 includes inner side 32, which faces toward interior 68 of ferrule 18, and outer side 34, which faces away from interior 68. During the method of the present invention, bristle inner tips 42 (shown in FIGS. 5A and 5B) are disposed in contact with outer side 34 of ferrule well base 30 and welding is applied to inner side 32 of ferrule well base 30. This welding permanently integrates bristles 38 with ferrule 18.

Figure 3A:
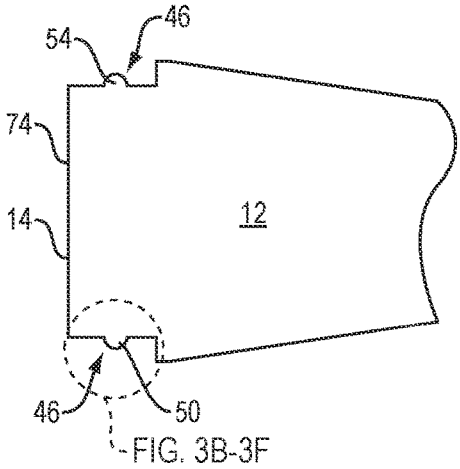
FIG. 3A is a partial side view of a handle of a makeup brush of the present invention.
Figure 2B:
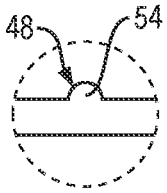
FIGS. 2B-2F are blown up views of several embodiments of connecting means on the ferrule shown in FIG. 2A.
Figure 3B:
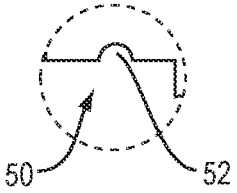
FIGS. 3B-3F are blown up views of several embodiments of connecting means on the handle shown in FIG. 3A, where the handle connecting means shown in FIGS. 3A-3F are releasably mateable with the ferrule connecting means shown in FIGS. 2A-2F, respectively.
Figure 3C:
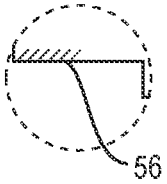

Still referring to FIG. 2A, on the right, we see an example of connecting means 46. Connecting means 46 are for connecting handle 12 and ferrule 18. In the preferred embodiment, as shown, the wall of the interior 68 of ferrule 18 includes an indentation 52, which is a ferrule snapping feature 48. Referring also to FIG. 3A, the remainder of the preferred connecting means 46 are shown in a partial side diagram of handle 12, in the form of handle snapping feature 50, which in this embodiment is protrusion 50, which releasably mates with indentation 52. One of ordinary skill in the art will recognize that there are several variations on this basic idea of ferrule and handle snapping features 48, 50. We now also refer to FIGS. 2B-2F and 3B-3F, which are exploded views of the sections of 2A and 3A that are circled with dashed lines. For example, as shown in FIGS. 2B and 3B, ferrule snapping feature 48 may be protrusion 54 (as opposed to indentation 52 shown in FIG. 2B) and handle snapping feature 50 may be indentation 52.

Figure 2C:
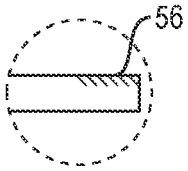
Figure 2D:
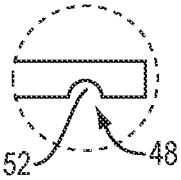
Figure 3D:
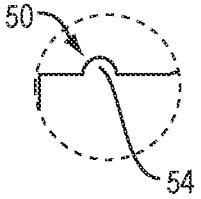
Figure 2E:
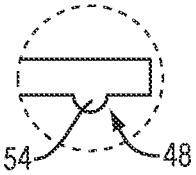
Figure 3E:
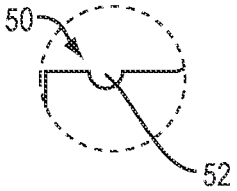
Figure 2F:
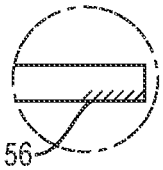
Figure 3F:
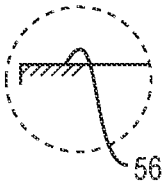
Figure 4A:
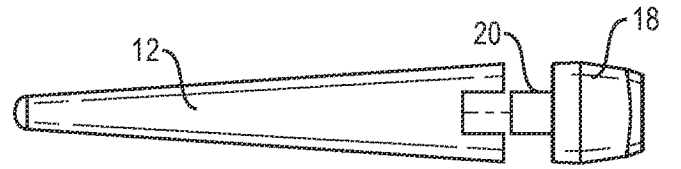
FIGS. 4A and 4B are side cutaway diagrams illustrating different ways that the ferrule and handle may fit together.
Figure 4B:
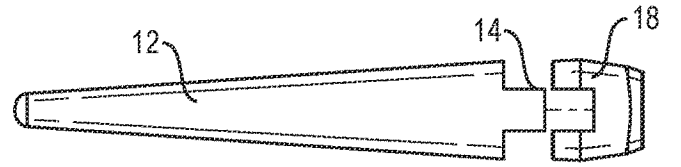

Referring now also to FIGS. 4A and 4B, side views of two versions of makeup brush 10 are shown. In FIG. 4A, ferrule 18 slips into handle 12, where dotted lines show where ferrule inner end 20 will set within handle 12. In FIG. 4B, handle 12 slips into ferrule 18, where dotted lines shown were ferrule end 14 of handle 12 will set within ferrule 18. In FIGS. 2A and 3A (together) and FIG. 4B, ferrule 18 and handle 12 are shown as preferred, where handle 12 will slip into ferrule 18, and, once unified, handle 12 and ferrule 18 will appear fairly flush with one another. As shown in FIG. 4A, however, another embodiment would have ferrule 18 slip into handle 12. In this embodiment, other variations of ferrule and handle snapping features 48, 50 are possible. For example, as shown in FIGS. 2D and 3D, as with FIGS. 2A and 3A, ferrule snapping feature 48 is indentation 52 and handle snapping feature 50 is protrusion 54, but unlike FIGS. 2A and 3A, indentation 52 is on the outside of ferrule 18 and protrusion 54 is on the inside of handle 12. Similarly, as shown in FIGS. 2E and 3E, like FIGS. 2B and 3B, ferrule snapping feature 48 is protrusion 54 and handle snapping feature 50 is indentation 52, but unlike FIGS. 2B and 3B, protrusion 54 is on the outside of ferrule 18 and indentation 52 is on the inside of handle 12.

Additionally, as shown in FIGS. 2C, 2F, 3C, and 3F, coordinating threading 56 may be included on the inside or outside of ferrule 18 and/or handle 12, such that ferrule 18 and handle 12 may be releasably screwed together, whether they are disposed as shown in FIG. 4A or 4B. Although snapping features 48, 50 and threading 56 are illustrated as the preferred connecting means 46, one of at least ordinary skill in the art will recognize that ferrule 18 and handle 12 may be releasably connected in many different manners, and each of these is considered to be within the scope of the present invention.

Figure 5B:
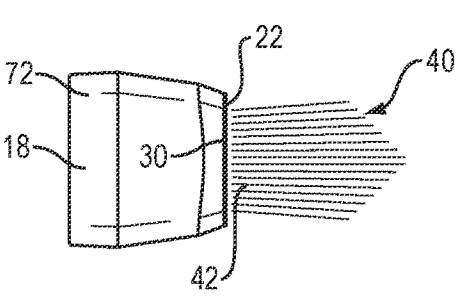
FIGS. 5A and 5B are side views of the ferrule showing a ferrule well disposed within the ferrule interior and a ferrule well flush with the ferrule outer end, respectively.
Figure 5A:
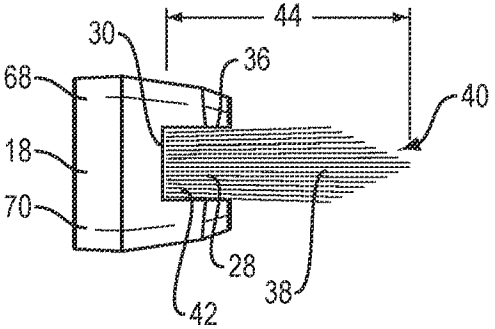

Now referring to FIGS. 5A and 5B, side views of ferrule 18 showing ferrule well 28 disposed within ferrule interior 68, and ferrule well 28 flush with ferrule outer end 22 are provided, respectively. In FIG. 5A, ferrule well 28 has ferrule well sides 36 that extend ferrule well 28 into interior 68 of ferrule 18. In FIG. 5B, ferrule well 28 has no depth and no ferrule well sides 36. Instead, ferrule well 28 is disposed directly at ferrule outer end 22. In both of FIGS. 5A and 5B, bristles 38 are attached at their bristle inner tips 42 to outer side 34 of ferrule well base 30 (shown most clearly in FIG. 2A) and a bristle length 44 extends out therefrom to bristle outer tips 40. Although it is preferred that ferrule well 28 include depth, as shown in FIG. 5A, having bristles 38 extend directly out from ferrule outer end 22, may be preferable for certain types of brushes. In such embodiments, practically speaking, ferrule well base 30 and ferrule outer end 22 are the same feature, but the details discussed above concerning how bristle inner tips 42 are disposed in contact with the outer side 34 of ferrule well base 30 and welding is applied to the inner side 32 of ferrule well base 30 are applicable in either of the embodiments shown in FIGS. 5A and 5B.

Figure 6B:
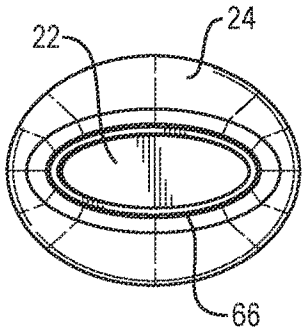
FIGS. 6A and 6B are top down views of the ferrule with circular and elliptical ferrule outer ends, respectively.
Figure 6A:
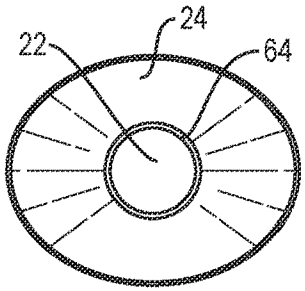

Now referring to FIGS. 6A and 6B, top down views of ferrule 18 with circular 64 and elliptical 66 ferrule outer ends 22 are provided, respectively. Ferrule inner end 20 is always the same shape and size as ferrule end 14 of handle 12, so that they may mate, and importantly, so that handle 12 may mate with any ferrule 18. Ferrule outer end 22 has no direct contact with handle 12, however, so it may accommodate different shapes, as shown in FIGS. 6A and 6B. It is understood that ferrule outer ends 22 may be any shape and the round shapes illustrated herein are merely exemplary.

Figure 7A:
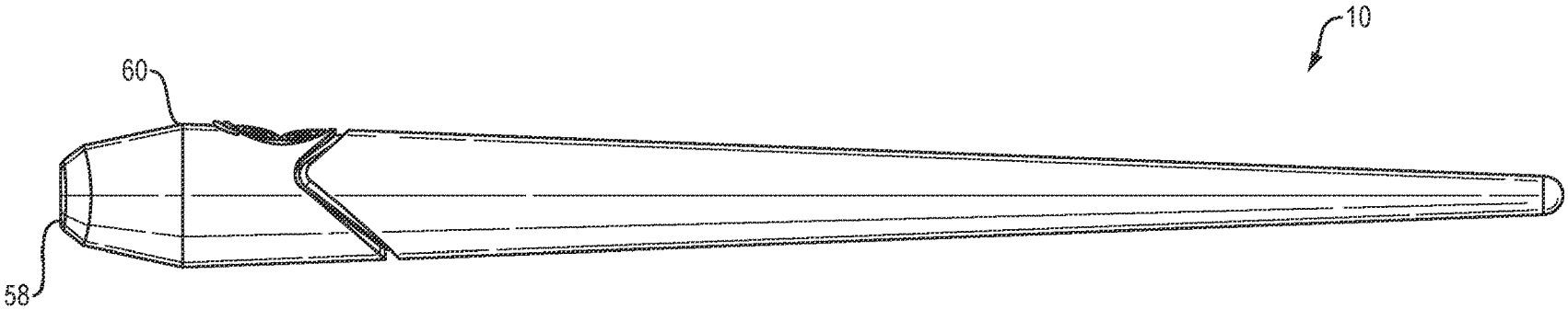
FIGS. 7A-7C are various views of one embodiment of the makeup brush of the present invention.
Figure 7C:
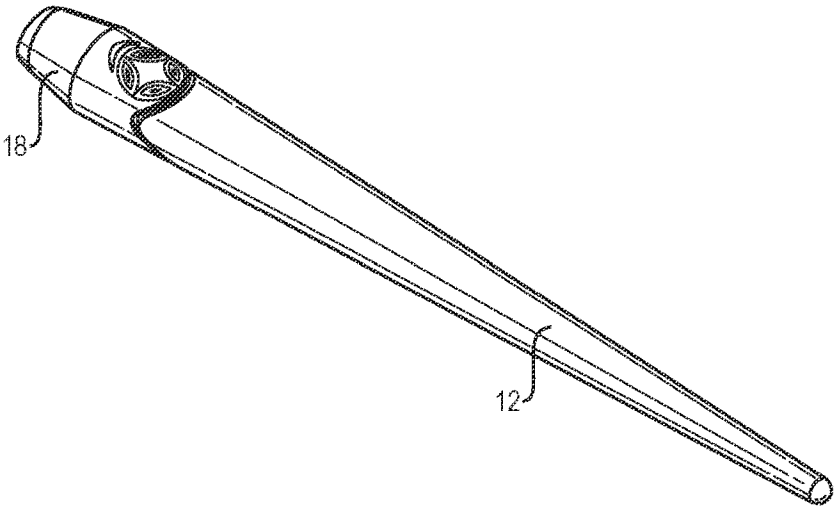
Figure 7B:
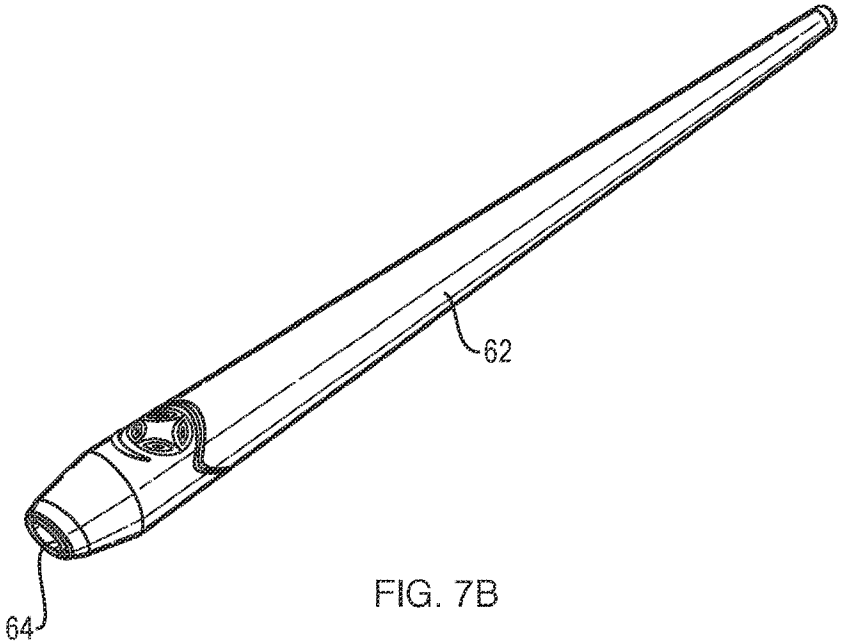
Figure 8A:
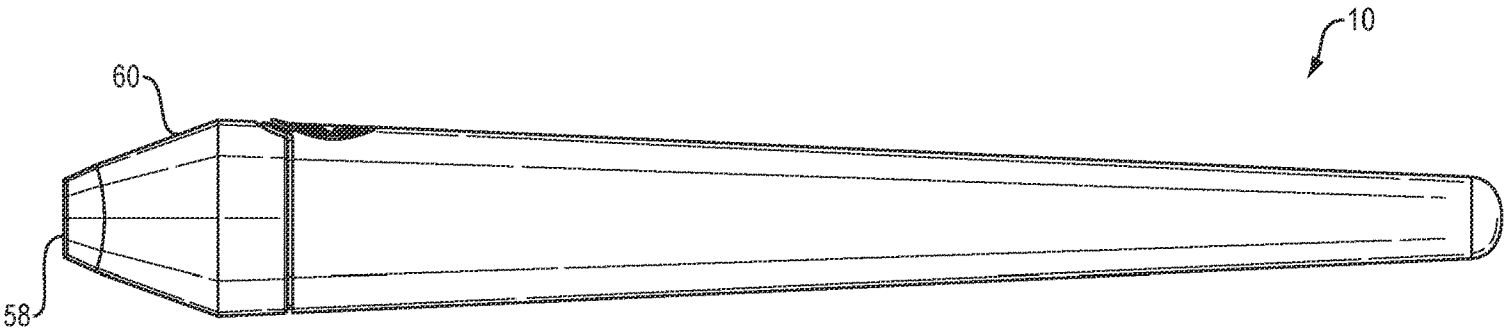
FIGS. 8A-8C are various views of a second embodiment of the makeup brush of the present invention.
Figure 8C:
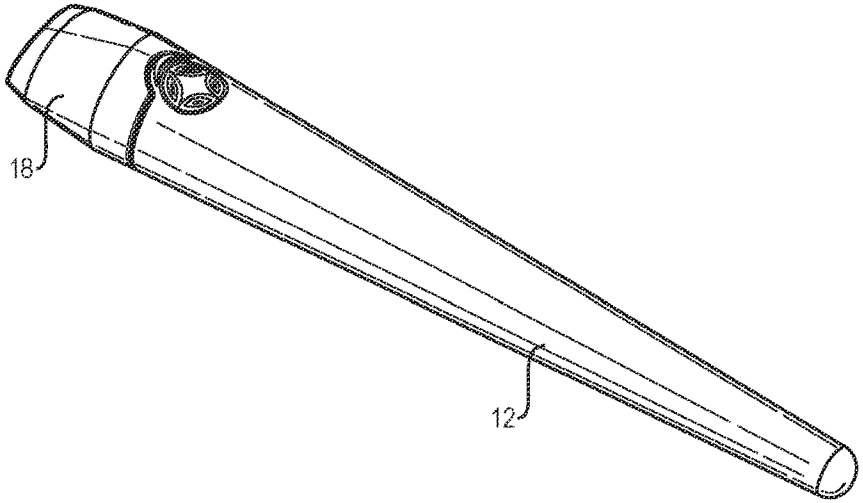
Figure 8B:
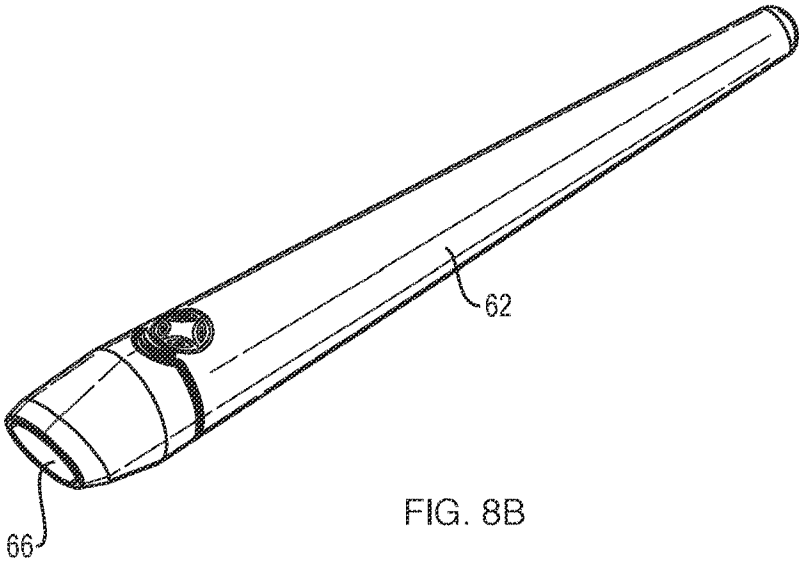
Figure 9A:
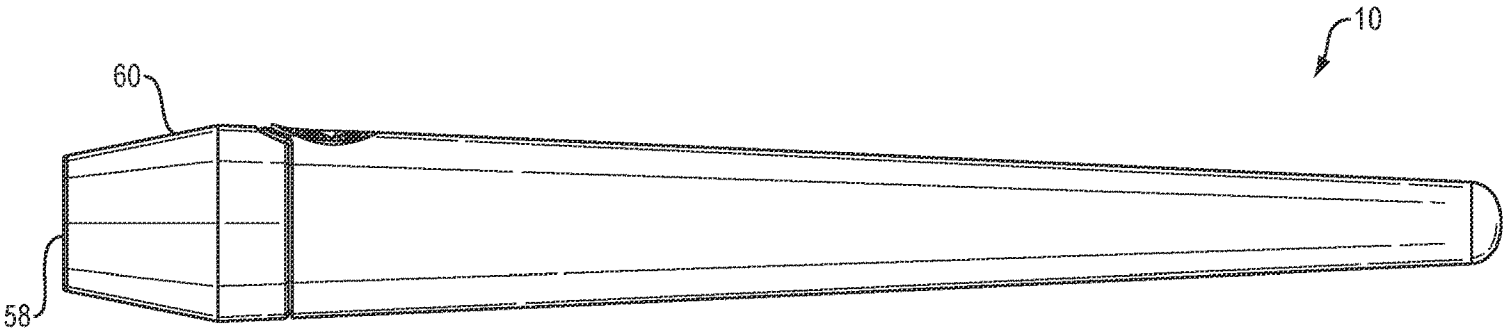
FIGS. 9A-9C are various views of a third embodiment of the makeup brush of the present invention.
Figure 9C:
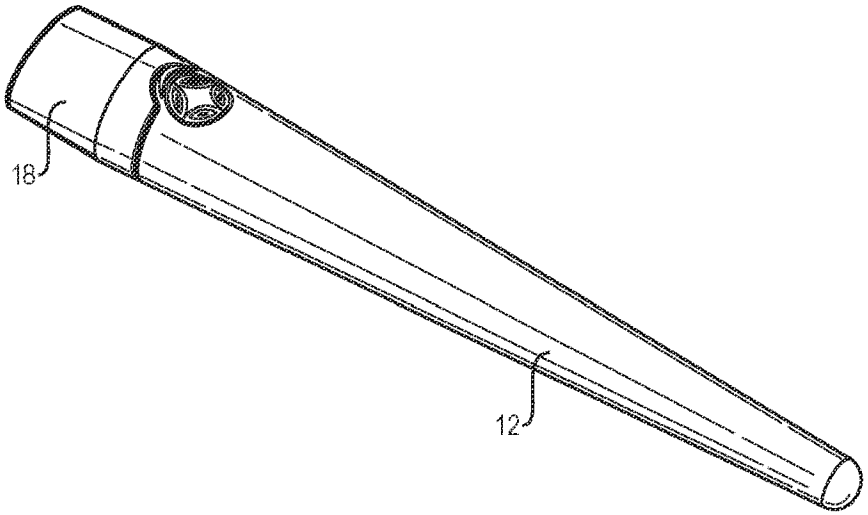
Figure 9B:
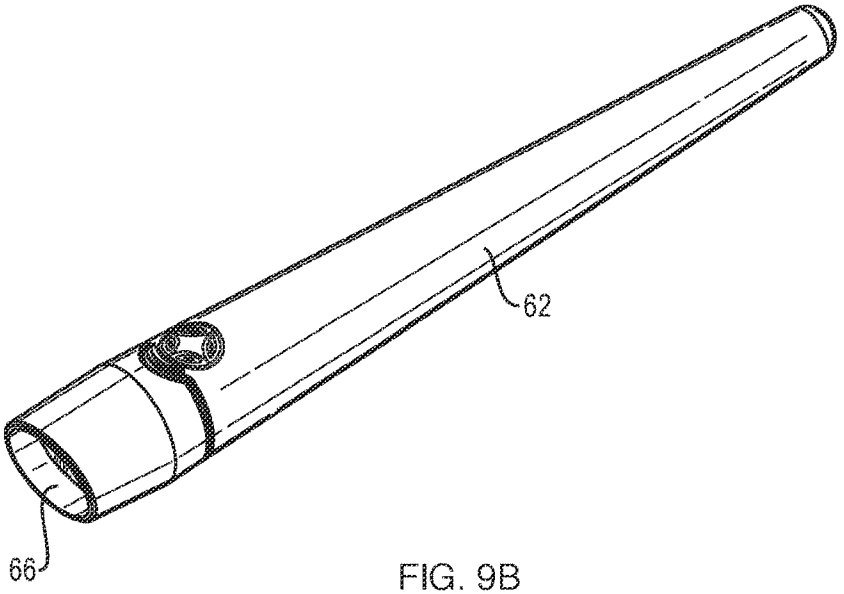
Figure 10A:
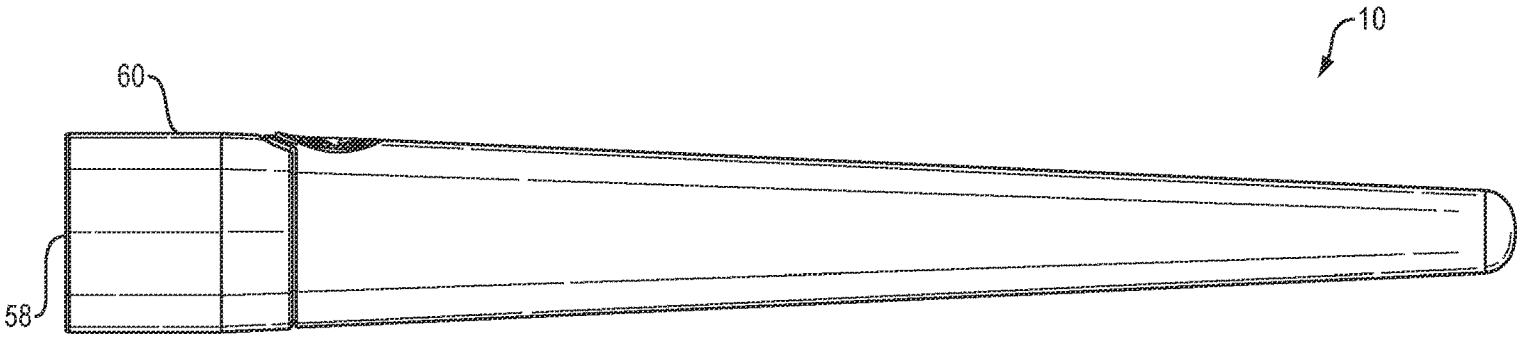
FIGS. 10A-10C are various views of a fourth embodiment of the makeup brush of the present invention.
Figure 10B:
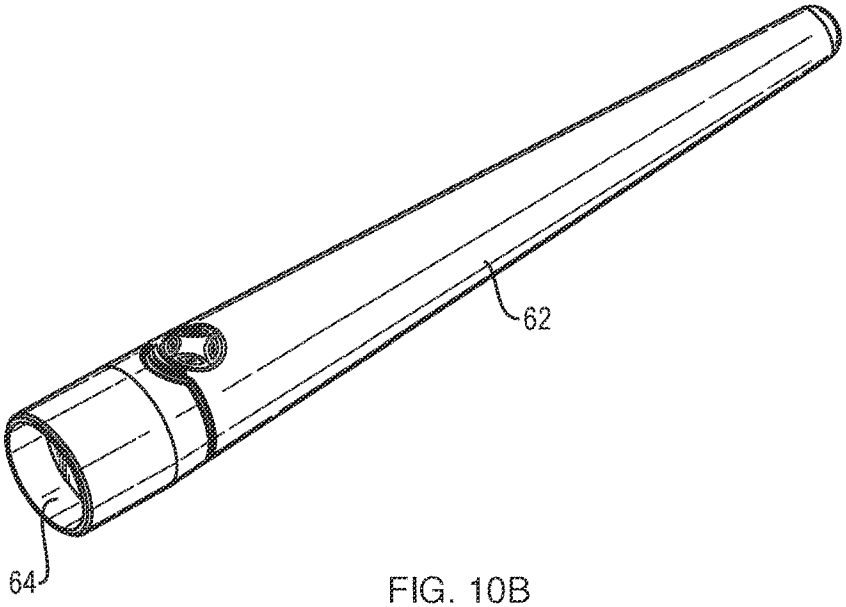
Figure 10C:
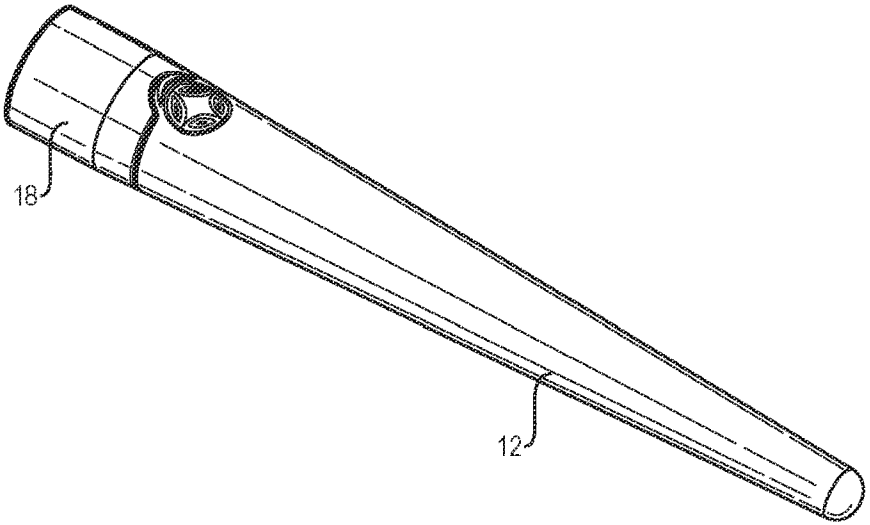

Now referring to FIGS. 7A-10C, various views of various embodiments of makeup brush 10 of the present invention are provided. The handles 12 of each embodiment are similar in length and similar in that they include tapering 62. The main differences are, instead, in the respective ferrules 18, as discussed below. FIGS. 7A-7C illustrate an eye liner brush according to the present invention. Ferrule outer end diameter 58 is less than ferrule inner end diameter 60, and ferrule outer end 22 has circular shape 64. FIGS. 8A-8C illustrate a foundation brush according to the present invention. Ferrule outer end diameter 58 is less than ferrule inner end diameter 60, and ferrule outer end 22 has elliptical shape 66. FIGS. 9A-9C illustrate blush brush according to the present invention. Ferrule outer end diameter 58 is less than ferrule inner end diameter 60, but the difference in the diameters 58, 60 is not as great as the difference illustrated in FIGS. 8A-8C, for example. Also like the makeup brush 10 shown in FIGS. 8A-8C, the blush brush shown in FIGS. 9A-9C has a ferrule outer end 22 with an elliptical shape 66. The minor axis of the elliptical shape 66 shown in FIG. 9B, however, is greater than the minor axis of the elliptical shape 66 shown in FIG. 8B, making the elliptical shape 66 shown in FIG. 9B rounder, or closer to being circular, than that shown in FIG. 8C. FIGS. 10A-10C illustrate a powder brush according to the present invention. In this embodiment, ferrule outer end diameter 58 and ferrule inner end diameter 60 are equal, and ferrule outer end 22 has circular shape 64. The makeup brushes 10 shown in FIGS. 7A-10C illustrate some of the variations possible within the scope of the present invention.

Figure 11:
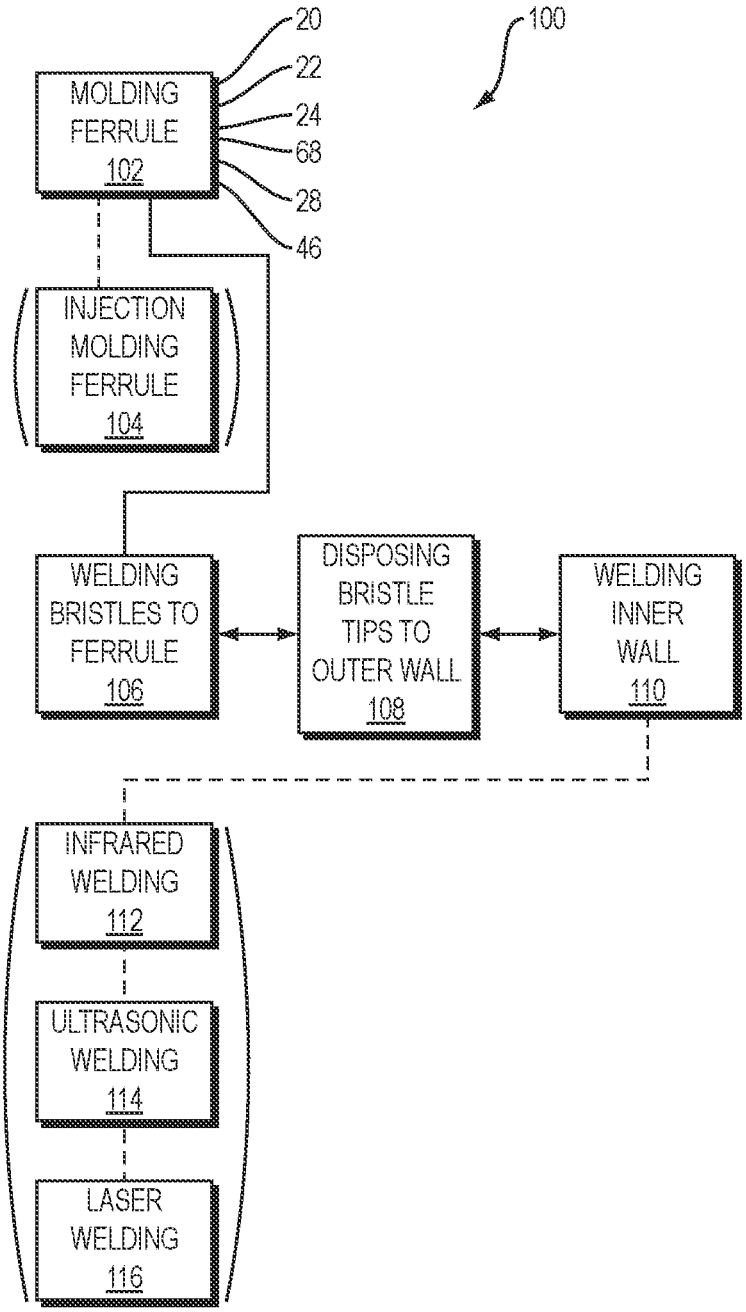
FIG. 11 is a flow chart identifying the steps of the method of the present invention.

Now referring to FIG. 11, a flow chart of method 100 of the present invention is provided. Method 100 includes molding the ferrule 102 and welding the bristles to the ferrule 106. The first step is molding ferrule 102. This step includes molding all of the required features of ferrule 18, including ferrule inner end 20, ferrule outer end 22, ferrule body 24, ferrule interior 68, ferrule well 28, and connecting means 46, all of which are discussed at length above. Although not all features of ferrule 18 may be listed here, it is understood that all features of ferrule 18 are molded in step 102. It is preferred that the step of molding ferrule is accomplished through injection molding 104. This step 104 is shown as dashed lines from step 102 and in parentheses to indicate that it is not a separate step from step 102, but a preferred manner of accomplishing step 102. In this context, injection molding has its common meaning within the art and analogous arts. That is to say, injection molding is a manufacturing process for producing parts by injecting molten material into a mold. In the present case, the molten material is preferably PBT or other elastomers or thermoplastic and thermosetting polymers, as discussed above.

The second step is welding bristles to the ferrule 106. This step 106 includes the substeps of disposing bristle tips to outer wall 108 and welding inner wall 110. Step 108 includes disposing the bristle inner tips 42 in contact with the outer side 34 of ferrule well base 30 (as shown, for example in FIGS. 2A and 5A). Step 110 includes applying welding to the inner wall 32 of ferrule well base 30 (shown in FIG. 2A). Step 110 is preferably accomplished through infrared welding 112, ultrasonic welding 114, or laser welding 116. Again steps 112, 114, and 116 are shown as dashed lines from step 110 and in parentheses to indicate that they are examples of accomplishing step 110, rather than separate steps. In this context, infrared welding has its common meaning within the art and analogous arts. That is to say, infrared welding is a non-contact thermal welding technique that heats thermoplastic parts to molten temperatures so that they may be permanently joined together. In this context, ultrasonic welding has its common meaning within the art and analogous arts. That is to say, ultrasonic welding is an industrial technique whereby high-frequency ultrasonic acoustic vibrations are locally applied to workpieces being held together to create a solid-state weld. It is commonly used for plastics, such as the polymers preferred in the current invention and discussed elsewhere herein. In this context, laser welding has its common meaning within the art and analogous arts. That is to say, laser welding or laser beam welding or LBW is a welding technique used to join pieces of metal or thermoplastics through the use of a laser. The laser beam provides a concentrated heat source, allowing for robust welds and high welding rates. Although the welding techniques described herein are preferred, one of ordinary skill in the art will recognize that other welding techniques common in the art may be substituted.

Figure 12A:
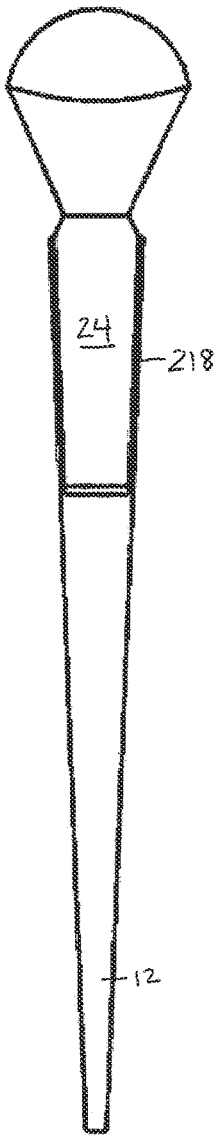
FIGS. 12A-12C are side cutaway views of a makeup brush of the present invention with a friction fit.
Figure 12B:
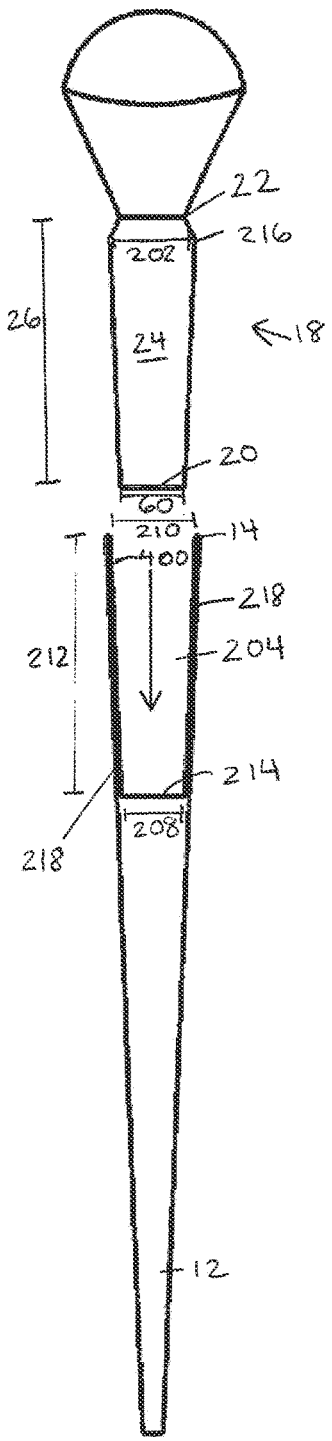

Now referring to FIGS. 12A and 12B side cutaway views of makeup brush 10 whose ferrule 18 and handle 12 are releasably connectable through a friction fit. Handle 12 has handle well 204 extending well height 212 into handle 12, between ferrule end 14 and handle well base 214. Handle well base 214 has handle well inner diameter 208. Ferrule end 14 has handle well outer diameter 210. Handle well outer diameter 210 is greater than handle well inner diameter 208 so that handle well 204 is tapered. Ferrule body 24 is similarly tapered and ferrule length 26 is close to well height 212. Ferrule body 24 has a widest point 216, which may be at ferrule outer end 22, but may be between ferrule outer end 22 and inner end 20, as shown. Widest point 216 has ferrule body widest diameter 202. Ferrule body widest diameter 202 is greater than ferrule inner end diameter 60. Ferrule inner end diameter 60 is slightly greater than handle well inner diameter 208. Ferrule body widest diameter 202 is slightly greater than handle well outer diameter 210. Ferrule inner end diameter 60 is less than handle well outer diameter 210. As such, ferrule inner end 20 of ferrule 18 passes easily into ferrule end 14 of handle 12. When ferrule body 24 is inserted far enough into handle well 204 that the surfaces of ferrule body 24 and handle well 204 come into intimate contact, the surface to surface tensions between those surfaces will hold ferrule body 24 in place within handle well 204. In some versions of this embodiment, the surfaces of ferrule body 24 and the inner surface 400 of handle well 204 are textured to aid in this surface to surface tension that allows for the handle well sides 218 to somewhat grip ferrule body 24.

Handle well sides 218 are preferably made of a flexible material so that the ferrule body 24 may be inserted and removed easily.

Figure 13A:
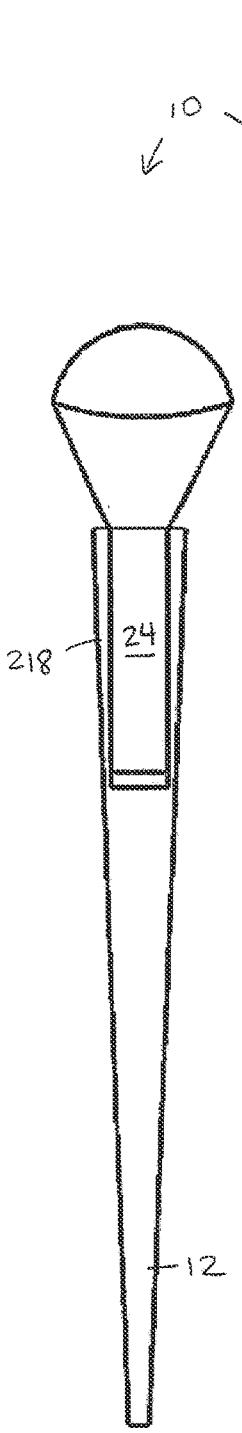
FIGS. 13A-13C are side cutaway views of an alternative embodiment of the makeup brush of the present invention with a friction fit.
Figure 13B:
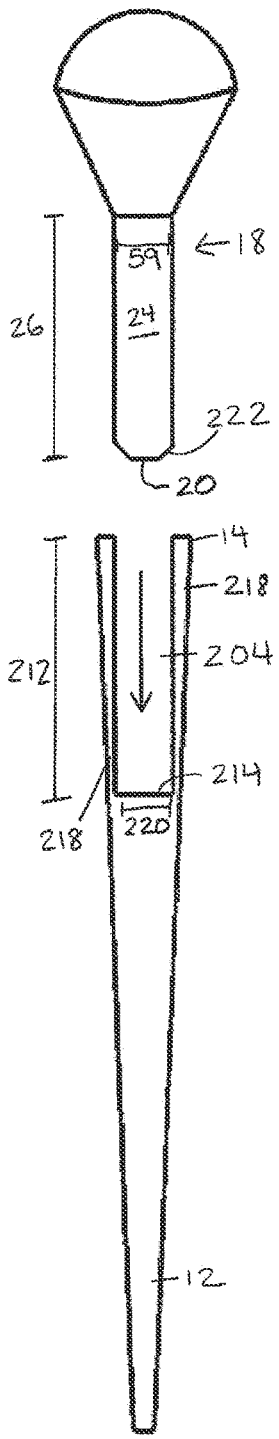

Now referring to FIGS. 13A and 13B, side cutaway views of an alternative embodiment of makeup brush 10 of the present invention with a friction fit are provided. Comparing this embodiment to that disclosed in FIGS. 12A and 12B, the main difference is that both the ferrule body 24 and the handle well 204 are cylindrical. As such, ferrule body 24 does not have disparate ferrule body widest point diameter 202 and ferrule inner end diameter 60, and instead has ferrule body diameter 59, which is consistent throughout ferrule length 26. Similarly, handle well 204 does not have disparate handle well inner and outer diameters 208, 210, and instead has handle well diameter 220 that is consistent throughout well height 212. Ferrule body diameter 59 is very slightly greater than handle well diameter 220 so that the respective diameters are almost equal. Ferrule body 24 needs to fit into handle well 204, so ferrule body diameter 59 cannot be much greater than handle well diameter 220. Handle well sides 218 are made of a flexible material so that they can distend slightly outward to accommodate the greater ferrule body diameter 59 when ferrule body 24 is inserted into handle well 204. The slight outward flexion allows the handle well 204 to grip ferrule body 24 and hold it in place. Because ferrule body diameter 59 and handle well diameter 220 are so nearly equal, it is preferred that ferrule inner end 20 have curved edges 222 that curve slightly in so that ferrule body 24 may more easily be guided into handle well 204.

Figure 12C:
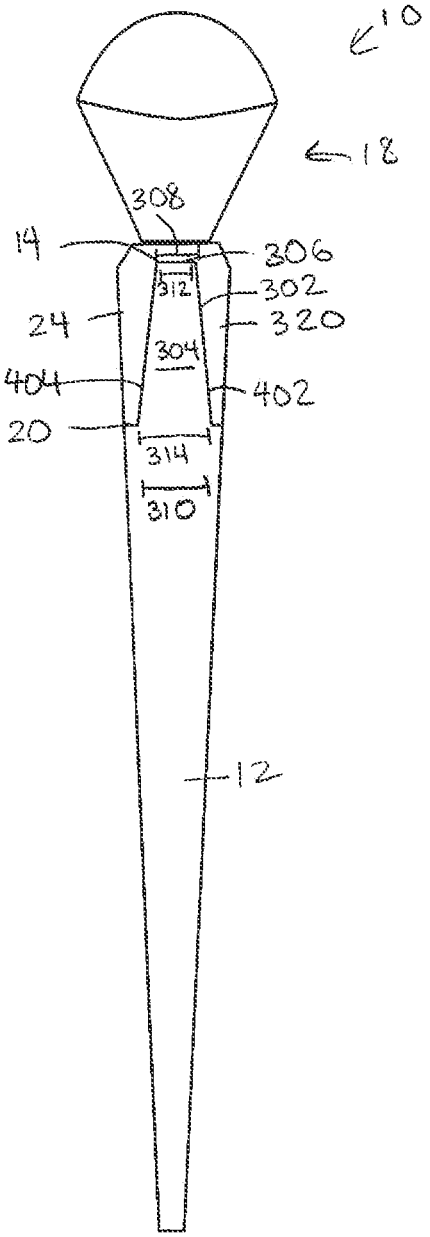
Figure 13C:
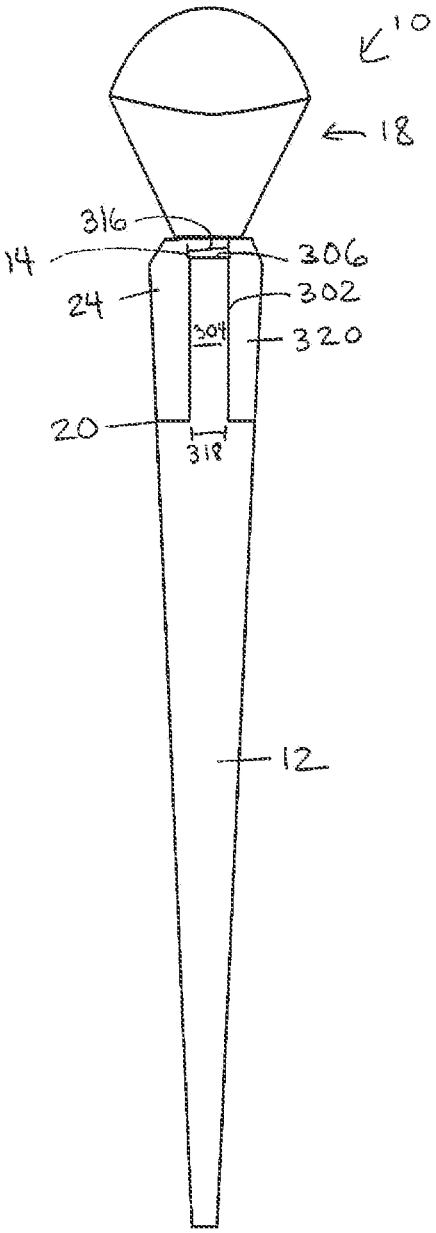

Now referring to FIGS. 12C and 13C, versions of makeup brush 10 with friction fits as described with relation to FIGS. 12A-12B and 13A-13B are provided. These versions are orientated as shown in FIG. 4B where handle 12 is inserted into ferrule 18, rather than as in FIGS. 4A (and 12A, 12B, 13A, and 13B), where ferrule 18 is inserted into handle 12. In these embodiments, instead of ferrule body 24 being inserted into handle well 204, as in FIGS. 12 A, 12B, 13A, and 13B, handle insert 304 is inserted into ferrule space 302. Ferrule space 302 in FIGS. 12C and 13C may be compared to handle well 204 in FIGS. 12A, 12B, 13A, and 13B, but is called "ferrule space 302" to avoid confusion with ferrule well 28, shown, e.g. in FIG. 2A.

FIG. 12C illustrates tapering similar to FIGS. 12A and 12B, where handle insert 304 has handle insert inner diameter 314, which is greater than handle insert outer diameter 312 at ferrule end 14 of handle 12. Ferrule space 302 has coordinating ferrule space inner diameter 308 at ferrule space base 306 and ferrule space outer diameter 310 at ferrule inner end 20. Handle insert inner diameter 314 is slightly greater than ferrule space outer diameter 310. Handle insert outer diameter 312 is slightly greater than ferrule space inner diameter 308. Although it may appear that handle insert 304 is completely inserted into ferrule space 302, it is understood that these slight differences in diameter would not allow that and that ferrule space sides 320 grip handle insert 304 as it is slid into ferrule space 302.

FIG. 13C illustrates a cylindrical handle insert 304 and ferrule space 302, similarly to FIGS. 13A and 13C. Ferrule space 302 has consistent ferrule space diameter 316, which is very slightly less than consistent handle insert diameter 318. Ferrule space sides 320 will grip handle insert 304 as it is slid into ferrule space 302. Although not shown, it is understood that handle insert 304 at ferrule end 14 may have rounded edges similar to curved edges 222 of ferrule end 20 of ferrule body 24, as shown in FIG. 13B. Given how close to equal ferrule space diameter 316 and handle insert diameter 318 are, again, such rounded edges aid in insertion. In the embodiments shown in FIGS. 12C and 13C, outer surface 402 of ferrule end 14 of handle 12 and inner surface 404 of ferrule space 302 may be textured to facilitate the surface to surface tension that allows the components to grip one another.

Figure 14A:
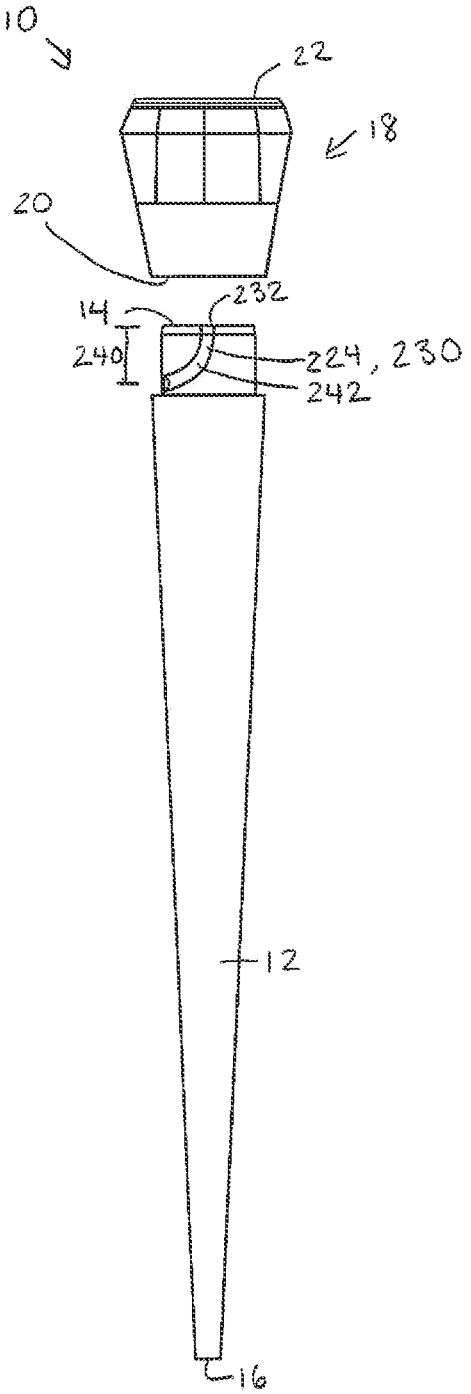
FIGS. 14A-14C are various side views of a makeup brush of the present invention with sliding features.
Figure 14B:
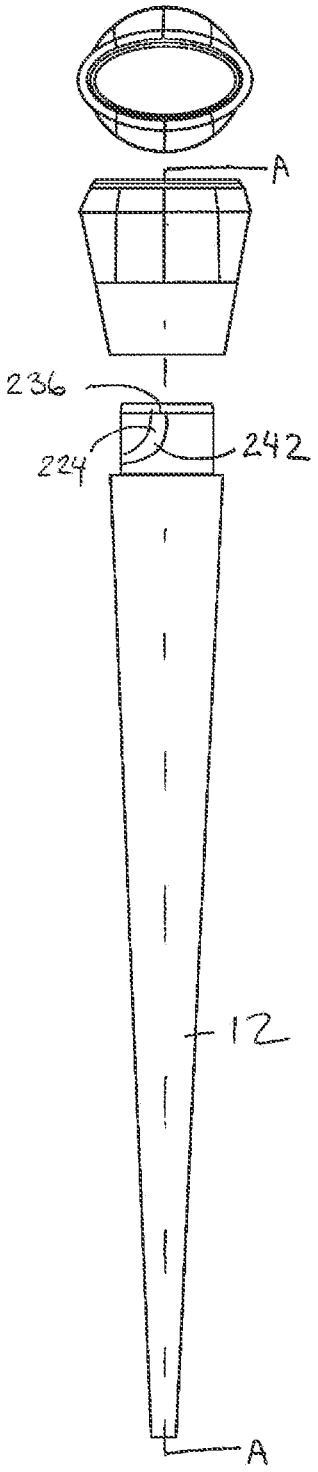
Figure 14C:
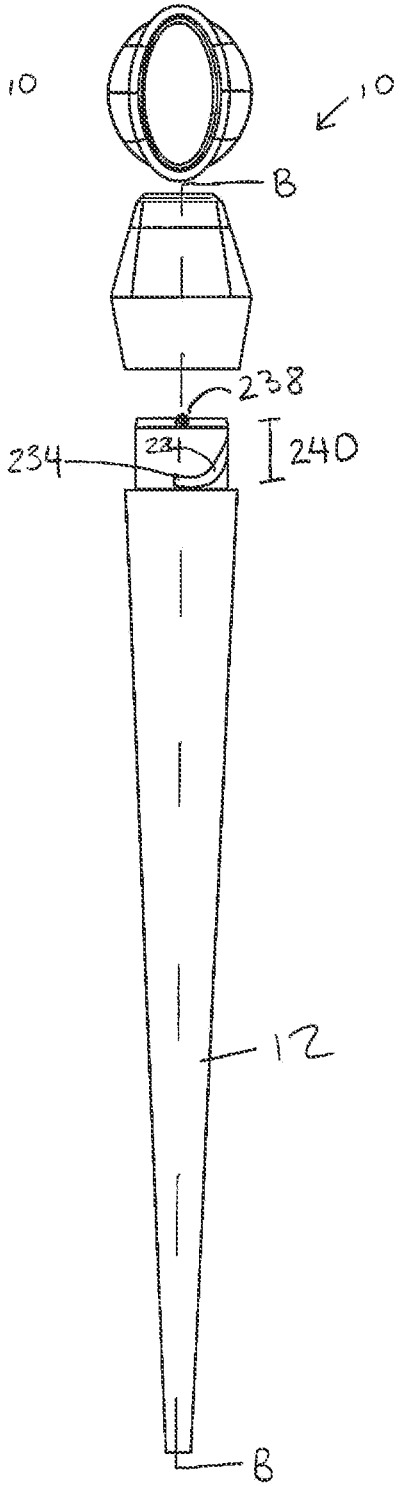
Figure 15A:
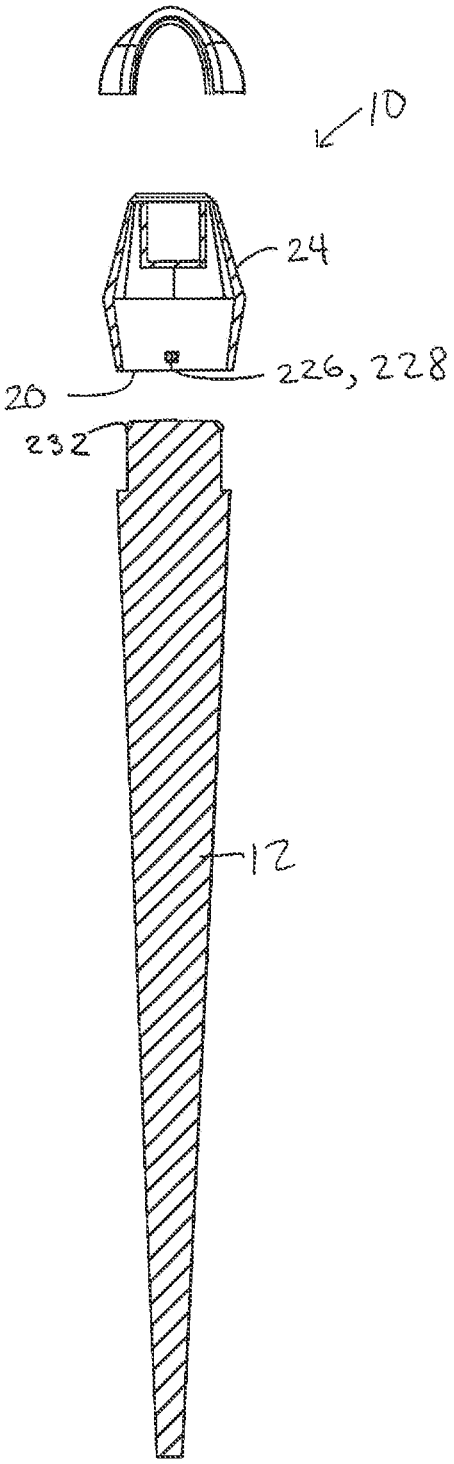
FIG. 15A is a cross section view of the makeup brush as shown in FIG. 14B along line A-A.
Figure 15B:
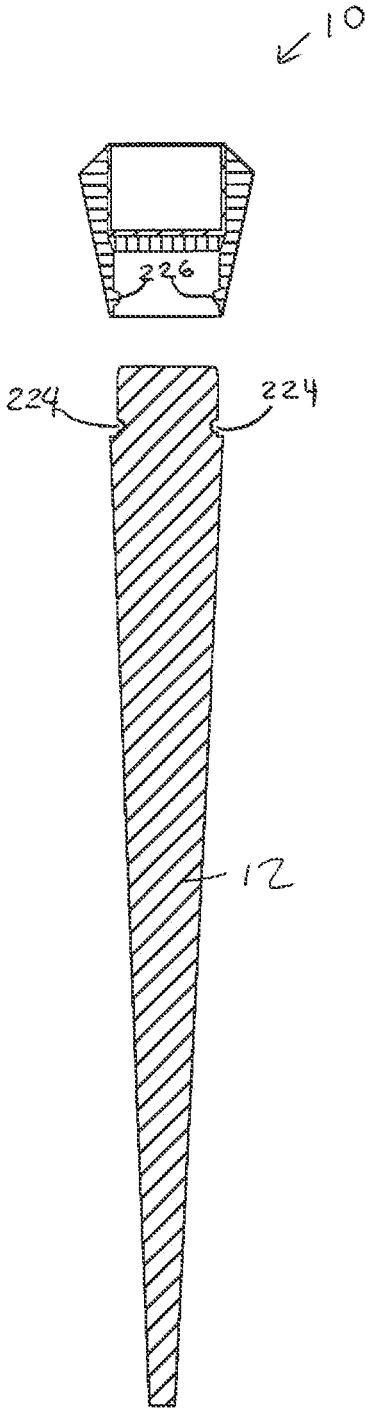
FIG. 15B is a cross section view of the makeup brush shown in FIG. 14C along line B-B.

Now referring to FIGS. 14A-14C and 15A-15B, various views of makeup brush 10 of the present invention that include sliding features 228, 230. FIGS. 14A-14C are side views of makeup brush 10. FIG. 15A is a cutaway view of makeup brush 10 as shown in FIG. 14B, along lines A-A. FIG. 15B is a cutaway view of makeup brush 10 as shown in FIG. 14C, along lines B-B. Makeup brush 10 shown in FIGS. 14A-14C is similar to that shown in FIGS. 9A-9C in that ferrule outer end 22 is elliptical in shape. In is understood, however, that the version described with respect to FIGS. 14A-14C and 15A-15B may be used with any embodiment of makeup brush 10 described herein, including any of those illustrated in FIGS. 7A-10C. As shown, ferrule sliding feature 228 is notch 226 and handle sliding feature 230 is channel 224. FIGS. 14A-14C show various views of makeup brush 10 twisted along the handle axis so as to collectively illustrate the entirety of channel 224 carved into ferrule end 14 of handle 12. As shown in FIG. 15A, notch 226 protrudes out from the interior of ferrule body 24, near ferrule inner end 20.

Channel 224 has channel opening 232 disposed at ferrule end 14 of handle 12. Channel 224 ends at channel terminal 234, shown most clearly in FIG. 14C. As channel 224 travels between channel opening 232 and channel terminal 234, it travels a lateral channel distance 240 away from ferrule end 14. In saying that channel distance 240 is a "lateral" distance 240, it indicates that this is not necessarily the length of channel 224 as measured between channel opening 232 and channel terminal 234. Instead, the "lateral" channel distance 240 is measured perpendicularly away from the plane of the ferrule end 14. Channel 224 includes L-bend 242, shown most clearly in FIG. 14B. L-bend 242 is a turn in channel 224 between channel opening 232 and channel terminal 234. L-bend 242 may be a soft, curved turn, as shown herein. L-bend 242 may be a sharper turn, however. Channel 224 may have an "L" shape, for example, rather than the curved shape shown. In other words, channel 224 may travel channel distance 240 perpendicularly into ferrule end 14, take a sharp 90° L-bend 242, and then travel horizontally to end at channel terminal 234.

Figure 16A:
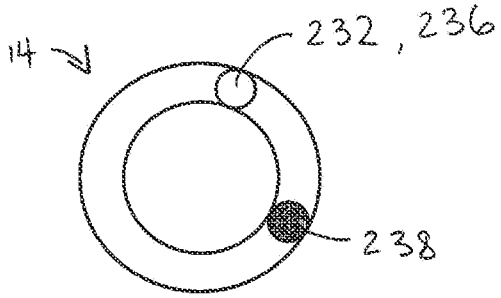
FIGS. 16A-16B are top-down views of the ferrule inner end of the ferrule and the ferrule end of the handle, respectively, in alternative embodiments of the makeup brush of the present invention.
Figure 16B:
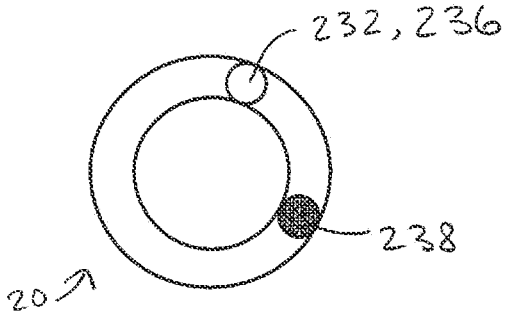

Importantly, channel opening 232 and channel terminal 234 are always at different positions with respect to ferrule end 14. If channel terminal 234 were directly behind or below channel opening 232, then notch 226 would not be held in place. In that case, any opposing forces applied to handle 12 and ferrule 18 would separate them. Now referring to FIG. 16A, these different positions are illustrated. FIG. 16A is a top-down view of ferrule end 14 of handle 12. Channel opening 232 is disposed on ferrule end 14 at channel opening position 236. Channel terminal position 238 is disposed at a different place on ferrule end 14. For the avoidance of doubt, channel terminal 234 is not disposed at channel terminal position 238. As shown in FIG. 14C, channel terminal 234 is channel distance 240 into handle 12 from channel terminal position 238.

Now referring to FIG. 15B, an embodiment where ferrule sliding feature 228 is two notches 226 is provided. Although not clear from this view, it is understood that notches 226 are two distinct protrusions, and not a line that extends all the way around that interior of ferrule inner end 20. In such embodiments, handle sliding feature 230 is two channels 224 that mate with notches 226 as described above.

All of the above discussion relating to FIGS. 14A-16A has related to embodiments of makeup brush 10 similar to that shown in FIG. 4B, where ferrule end 14 of handle 12 is inserted into ferrule inner end 20 of ferrule 18 to connect handle 12 and ferrule 18. Ferrule and handle sliding features 228, 230 may be also be reversed so that handle sliding feature is notch 226 and ferrule sliding feature is channel 224. Either version may also apply to embodiments similar to that shown in FIG. 4A, where ferrule inner end 20 of ferrule 18 is inserted into ferrule end 14 of handle 12 for the connection. In other words, the concept illustrated in FIGS. 2A/3A, 2B/3B, 2D/3D, and 2E/3E with respect to snapping features 48, 50 can also be applied to sliding features 228, 230. In a first version, as illustrated in FIGS. 14A-16A, ferrule sliding feature 228 is notch 226 on the inside of ferrule inner end 20 and handle sliding feature 230 is channel 224 on the outside of ferrule end 14. This is used in embodiments such as that shown in FIG. 4B, where handle 12 is inserted into ferrule 18, and is comparable to snapping features 48, 50 as shown in FIGS. 2B/3B, where ferrule snapping feature 48 is protrusion 54 on the inside of ferrule inner end 20 and handle snapping feature 50 is indentation 52 on the outside of ferrule inner end 20. Also with an embodiment such as that shown in FIG. 4B, wherein handle 12 is inserted into ferrule 18, ferrule sliding feature 228 may be channel 224 carved into the inner walls of ferrule inner end 20 and handle sliding feature 230 may be notch 226 protruding out of ferrule end 14 of handle 12. This is comparable to the snapping features 48, 50 shown in FIGS. 2A/3A. There are, of course, also versions to be used with embodiments such as those shown in FIG. 4A, where ferrule 18 is inserted into handle 12. In these, ferrule sliding feature 228 may be notch 226 protruding from the outside of ferrule inner end 20 and handle sliding feature 230 is channel 224 carved into the inside of ferrule end 14. This is comparable to the snapping features 48, 50 shown in FIGS. 2E/3E. Finally, again with an embodiment such as that shown in FIG. 4A, ferrule sliding feature 228 may be channel 224 carved into the outside of ferrule inner end 20 and handle sliding feature 230 is notch 226 protruding from the inside of ferrule end 14. This is comparable to the snapping features 48, 50 shown in FIGS. 2D/3D. Referring to 16B, a top-down view of ferrule inner end 20 is shown with channel opening 232, channel opening position 236, and channel terminal position 238. This view is applicable to versions where ferrule sliding feature 228 is channel 224, which may be with either of the embodiments shown in FIGS. 4A and 4B, as discussed above.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

I claim:

1. A makeup brush comprising:

a handle with a ferrule end and a holding end;

a ferrule comprising:

a ferrule inner end connectable to said ferrule end of said handle;

a ferrule outer end;

an interior;

a ferrule body with a ferrule length extending between said inner and outer ends and around said interior; and a well disposed at said ferrule outer end, wherein said well comprises a well base parallel to said ferrule outer end, wherein said well base comprises an inner side that faces toward said interior of said ferrule body and an outer side that faces away from said interior of said ferrule;

a plurality of bristles, wherein:

each of said bristles comprises a bristle outer tip, a bristle inner tip, and a bristle length extending between said bristle outer and inner tips;

said bristles extend out of said ferrule; and said inner tips of said bristles are integrally attached to said outer side of said well base of said ferrule; and means for releasably connecting said ferrule to said handle, wherein:

said ferrule inner end is releasably connected to said ferrule end of said handle;

said means for releasably connecting said ferrule to said handle comprises a ferrule sliding feature disposed on said ferrule that releasably mates with a handle sliding feature disposed on said handle; and said ferrule sliding feature is one of at least one channel carved into or at least one notch protruding out from said ferrule body and said handle sliding feature is an other of at least one notch protruding out from or at least one channel carved into said handle, wherein:

said at least one notch releasably slides into said at least one channel;

each of said at least one channel comprises:

a channel opening;

channel terminal; and an L-bend between said channel opening and said channel terminal;

said channel opening is disposed at one of said ferrule inner end of said ferrule or said ferrule end of said handle at a channel opening position;

said channel travels a lateral channel distance away from one of said ferrule inner end of said ferrule or said ferrule end of said handle;

a channel terminal position is further disposed at said one of said ferrule inner end of said ferrule or said ferrule end of said handle;

said channel opening position and said channel terminal position are distinct; and said channel terminal is disposed said channel distance away into said one of said ferrule inner end of said ferrule or said ferrule end of said handle, from said channel terminal position.

2. The makeup brush as claimed in claim 1, wherein said ferrule body is round.

3. The makeup brush as claimed in claim 1, wherein said ferrule well base of said ferrule well of said ferrule is disposed slightly within said interior of said ferrule body and said ferrule well further comprises ferrule well sides connecting said ferrule well base to said ferrule outer end.

4. The makeup brush as claimed in claim 1, wherein said inner tips of said bristles are integrally attached to said outer side of said well of said ferrule.

5. A The makeup brush as claimed in claim 4, wherein said integral attachment is achieved through welding said inner side of said well of said ferrule.

6. The makeup brush as claimed in claim 1, wherein said ferrule inner end of said ferrule comprises a flat base.

* * * * *